US005743486A

United States Patent [19]

Bulman

[11] Patent Number: 5,743,486

[45] Date of Patent: Apr. 28, 1998

[54] KNOCKDOWN REEL

[75] Inventor: Leonard C. Bulman, Postville, Iowa

[73] Assignee: Reel-Core, Inc., Waukon, Iowa

[21] Appl. No.: 764,779

[22] Filed: Dec. 12, 1996

[51] Int. Cl.[6] ..... B65H 75/14; B65H 75/22

[52] U.S. Cl. ..... 242/608.5; 242/118.62

[58] Field of Search ..... 242/608.4, 608.6, 242/118.62, 118.61, 608.5

[56] References Cited

U.S. PATENT DOCUMENTS

| | | | |
|---|---|---|---|
| 156,413 | 11/1874 | Darrow et al. | 242/118.62 |
| 1,846,397 | 2/1932 | Kennedy | 242/118.62 |
| 1,984,244 | 12/1934 | Wilson . | |
| 2,141,610 | 12/1938 | Little et al. . | |
| 2,527,519 | 10/1950 | Bliss | 242/118.61 |
| 2,542,554 | 2/1951 | Miller . | |
| 2,546,253 | 3/1951 | Beauregard | 242/608.4 X |
| 2,663,073 | 12/1953 | Bieber et al. | 242/118.61 |
| 2,837,297 | 6/1958 | Moss . | |
| 3,104,851 | 9/1963 | Portal . | |
| 3,523,550 | 8/1970 | Richardson . | |
| 3,822,841 | 7/1974 | Campbell | 242/608.6 |
| 3,846,887 | 11/1974 | Woods et al. . | |
| 4,083,450 | 4/1978 | La Mar . | |
| 4,462,555 | 7/1984 | Olson et al. . | |
| 5,379,965 | 1/1995 | Isler et al. . | |

FOREIGN PATENT DOCUMENTS

| | | | |
|---|---|---|---|
| 140978 | 7/1930 | Switzerland . | |
| 464623 | 12/1968 | Switzerland | 242/118.61 |

*Primary Examiner*—Daniel P. Stodola
*Assistant Examiner*—Gregory J. Strimbu
*Attorney, Agent, or Firm*—Henderson & Sturm

[57] ABSTRACT

A knockdown reel comprised of a core having threaded ends and end flanges attached to the threaded ends. The flanges are adapted to be attached to or removed from the threaded ends of the core for retaining the material rolled onto the core. A snap locking mechanism is provided on the flanges and on the core to hold the flanges securely to the core when the reel is to be used.

2 Claims, 2 Drawing Sheets

KNOCKDOWN REEL

CROSS-REFERENCE TO RELATED APPLICATIONS

Not Applicable

STATEMENT REGARDING FEDERALLY SPONSORED RESEARCH OR DEVELOPMENT

Not Applicable

AUTHORIZATION PURSUANT TO 37 C.F.R. §1.71 (d) (e)

A portion of the disclosure of this patent document, including appendices, may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to reels for storing hose, cable, wire and the like, and more particularly to a molded plastic reel having a core section and two end flange sections which can be releasably connected to the ends of the core.

2. Description of the Related Art

There are many reels available for holding hose, cable, wire or the like. Most of these reels are constructed of wood or metal or both. A major problem with the prior art wooden or metal reels is that they are heavy and cannot be easily disassembled for shipping. Consequently, they cannot nest easily with one another, and because of their weight, shipping costs are increased. Furthermore, these prior art reels are not recyclable as is the case of objects made of certain types of plastics.

It is, of course, much easier for shipping and handling if the flanges and cores remain separate until they are ready to be used. Although reels are available that can be knocked down where the end flanges are removed for shipping, known reels have major disadvantages. Some knockdown reels, for example, include a threaded connection between the core and the flanges where the flanges may be inadvertently loosened and removed. Structures used to prevent this unintentional removal have been very complicated and difficult to use.

Those concerned with these and other problems recognize the need for an improved knockdown reel.

BRIEF SUMMARY OF THE INVENTION

The present invention discloses a knockdown reel comprised of a core having threaded ends and end flanges attached to the threaded ends. The flanges are adapted to be attached to or removed from the threaded ends of the core for retaining the material rolled onto the core. A snap locking mechanism is provided on the flanges and on the core to hold the flanges securely to the core when the reel is to be used.

The snap locking mechanism comprises an annular tapered locking ring disposed at each end of the core and a mating annular tapered locking ring disposed on the flanges. When the flanges are fully threaded onto the core, the locking rings engage to prevent inadvertent unthreading.

An object of the present invention is to provide an improved knockdown reel.

Another object of the present invention is to provide a knockdown reel which is constructed of a core which is separable for shipping and handling purposes from the side flanges and which can be easily assembled when it is desired to use the reel.

A further object of the present invention is to provide a knockdown reel which is light, easy to ship and transport, easy to assemble and which can be recycled when its usefulness has diminished.

A still further object of the present invention is to provide a method and apparatus for quickly and easily threading flanges onto the ends of the core with locking devices which will securely hold the flanges onto the ends of the core.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
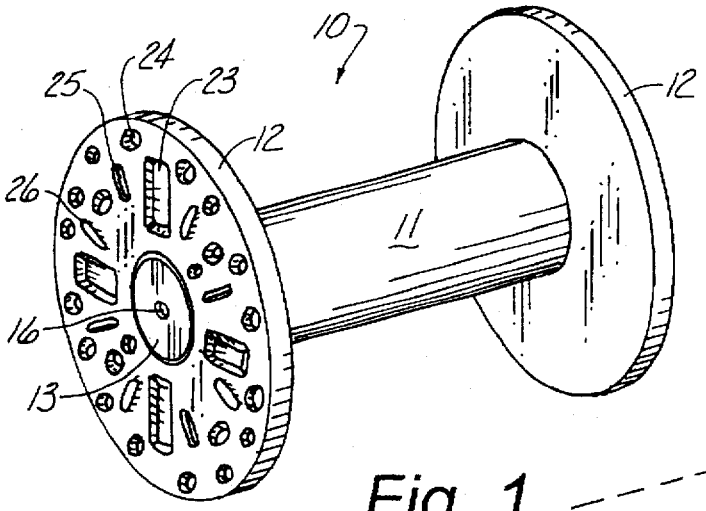
FIG. 1 is a perspective view of a knockdown reel constructed in accordance with the present invention.

Referring now to the drawings, wherein like reference numerals designate identical or corresponding parts throughout the several views, FIG. 1 shows a reel (10) constructed in accordance with the present invention and having a core (11) with flanges (12) attached to each end thereof. The flanges (12) are substantially identical.

Figure 2:
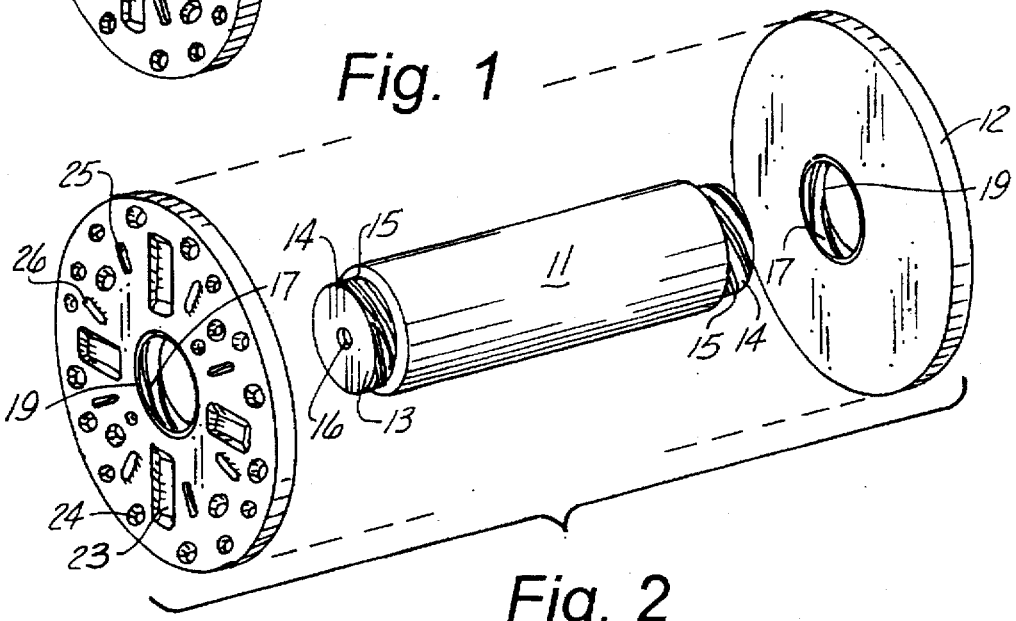
FIG. 2 is an exploded perspective view of the reel of FIG. 1 showing a core and two side flanges.

Referring to FIG. 2, it is noted that the core (11) is essentially blow-molded and is hollow. A flat and planar end portion (13) is disposed on each end thereof. An annular tapered locking ring (14) and threads (15) are sequentialy formed at each end; wherein the annular locking ring (14) is formed adjacent the flat and planer end portion. An opening (16) is disposed in each of the end portions (13) so that a shaft (not shown) can be extended therethrough in order to rotatably mount the reel (10) as is conventional.

Each of the flanges (12) also has a threaded opening (17) which is complementary to the threads (15) on the core (11). The flanges (12) are also hollow and blow-molded from polyethylene plastic, as is the core (11).

Figure 5:
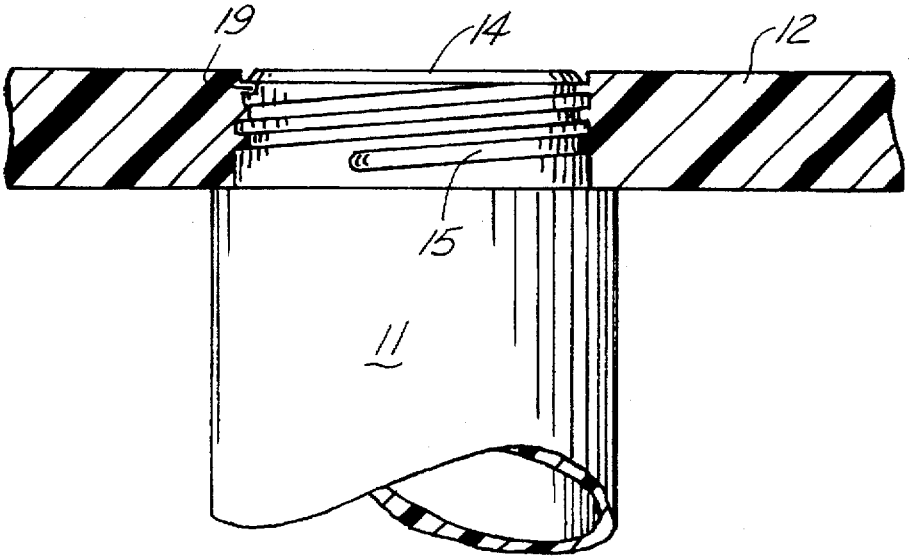
FIG. 5 is an enlarged sectional view of a portion of a flange and core showing the locking rings engaged.
Figure 6:
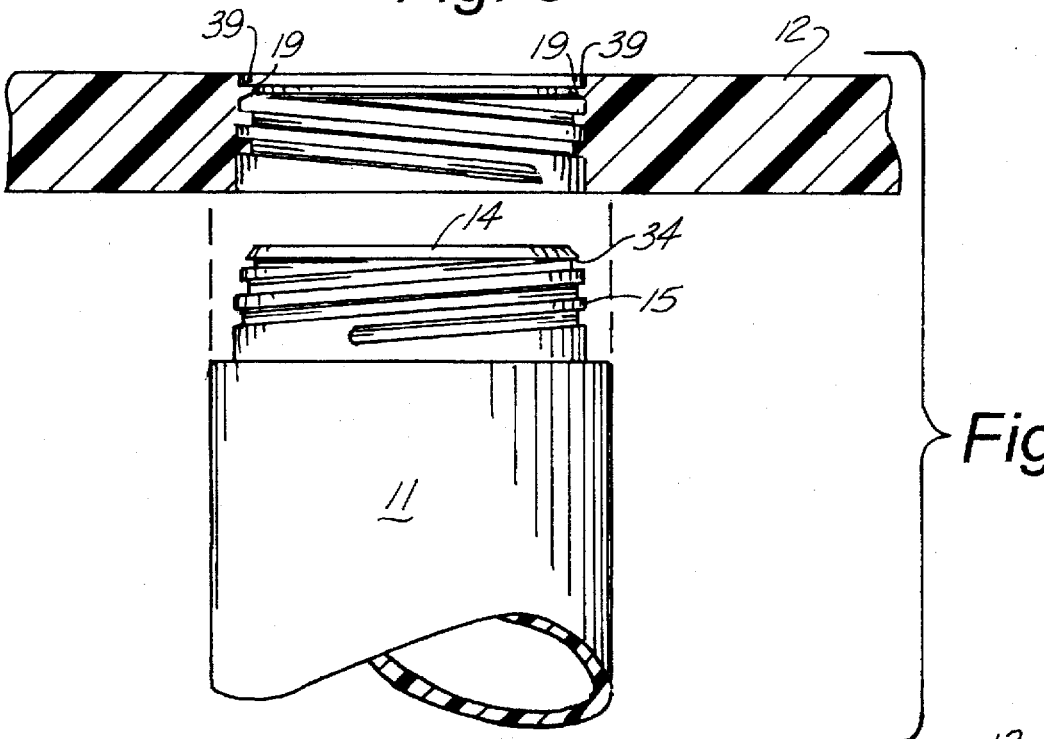
FIG. 6 is an enlarged exploded sectional view similar to FIG. 5, but showing the flange disengaged from the core.
Figure 7:
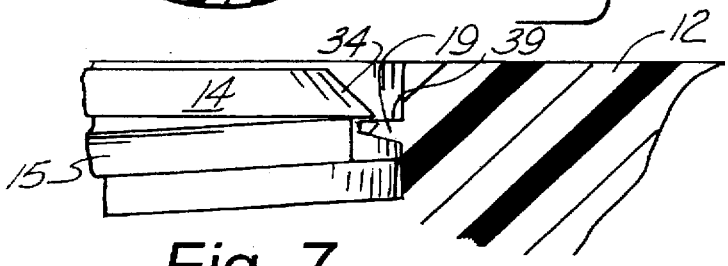
FIG. 7 is a greatly enlarged sectional view of a flange and core showing the locking rings engaged.

The opening (17) in each center portion of each flange (12) also has an annular tapered locking ring (19) spaced from the outboard face of each flange (12). The locking rings (14) of the core (11) engage the locking rings (19) of the flanges (12) when the core (11) and flanges (12) all fully threaded together as best shown in FIGS. 5 and 7.

Figure 3:
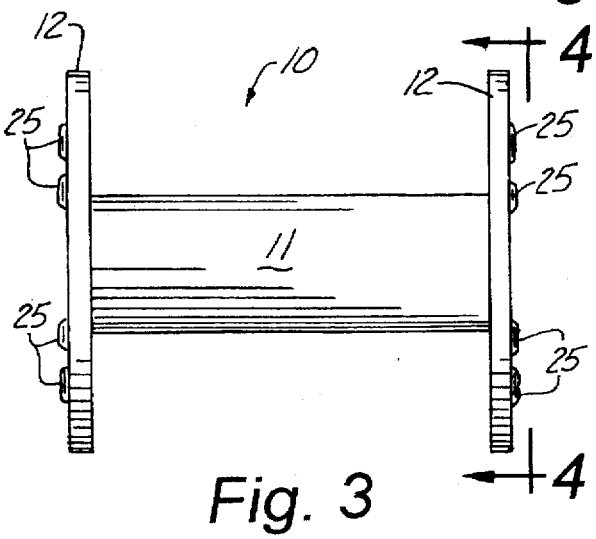
FIG. 3 is a side elevational view of the reel of FIG. 1.
Figure 4:
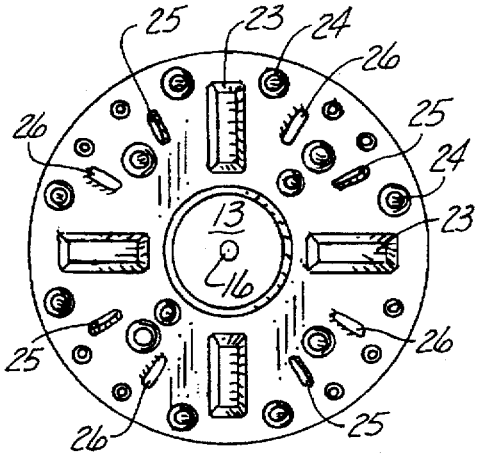
FIG. 4 is a side elevational view taken along line 4—4 of FIG. 3.

Referring to FIGS. 3 and 4, it is noted that the flange (12) is hollow and has numerous indentations (23) and (24) for adding structural integrity to the flange (12). Raised portions (25) will nest into indentations (26) so that these flanges can be stacked for storage purposes and this nesting of projections (25) into indentations (26) will prevent one flange (12) from sliding with respect to the next flange (12) for storage purposes and will also aid in making them more compact for storage purposes.

Consequently, the flanges (11) can be stacked in one box and the cores (11) placed in another box and shipped either separately or together. When it is desired to assemble the reel (10), one of the cores (11) and two of the flanges (12) are used, for example, as shown in FIG. 2 wherein each of the flanges (12) is aligned properly and threaded onto the core (11) turning it in the required direction.

Once both flanges (12) have been threaded on the core (11) to the point where they are snug, the reel (10) is placed so that one of the flanges (12) is on the floor. The person assembling the reel (10) will then stand on the flat, upwardly facing portion of the floor engaging flange (12) while at the same time grasping the upper flange (12) to further turn the flange to tighten the threads onto the core (11). This will snap the locking rings (14) of the core (11) over the respective locking rings (19) of the flanges (12) to the position shown in FIGS. 5 and 7 so that one edge (34) of locking ring (14) will be in a position over the adjacent surface (39) of each locking ring (19) of the flanges (12), such that the planar end portion (13) of the core (11) are disposed flush with the texture surface of the flanges. This snap-lock feature will prevent inadvertent unthreading of the flange (12) with respect to the core (11).

Of course if it is desired to take the flanges (12) off of the core (11), the assembly process is simply reversed to pop the locking rings (14 and 19) out of engagement after which the flange (12) is turned to unscrew the flange (12) from the core (11). This, of course, would be a very deliberate act, possible because the locking rings (14 and 19) are constructed of polyethylene plastic material which is relatively resilient. They would be held in the locked position shown in FIGS. 5 and 7 unless this deliberate act of unlocking is undertaken.

Accordingly it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A snap-fit reel assembly comprising:

a core having threaded ends, each end being provided with a first resilient tapered annular locking ring disposed on an outboard end of each threaded end; and a pair of flanges wherein each flange is adapted to be removably connected to one of the threaded ends of the core, each flange including a threaded opening and a second resilient tapered annular ring spaced from one face of each flange, whereby fully threadable engagement of the core and the flanges results in a snap lock fit between the first and second locking rings.

2. The reel assembly as in claim 1, wherein the first locking ring on each end of the core is disposed flush with one face of each of the flanges when the flanges and core are in full threadable engagement.

* * * * *